US012258176B1

(12) United States Patent
Linehan

(10) Patent No.: US 12,258,176 B1
(45) Date of Patent: Mar. 25, 2025

(54) CONTAINER WITH ADJUSTABLE STORAGE SPACE

(71) Applicant: Edward Cornelius Linehan, Wakefield, MA (US)

(72) Inventor: Edward Cornelius Linehan, Wakefield, MA (US)

( * ) Notice: Subject to any disclaimer, the term of this patent is extended or adjusted under 35 U.S.C. 154(b) by 0 days.

(21) Appl. No.: 18/769,169

(22) Filed: Jul. 10, 2024

Related U.S. Application Data

(60) Provisional application No. 63/596,512, filed on Nov. 6, 2023.

(51) Int. Cl.
*B65D 21/08* (2006.01)
*B65D 41/04* (2006.01)

(52) U.S. Cl.
CPC ..... *B65D 21/086* (2013.01); *B65D 41/04* (2013.01)

(58) Field of Classification Search
CPC ..... B65D 21/086; B65D 21/08; B65D 7/24; B65D 83/0072; B65D 83/0077; B65D 41/04
USPC ..... 220/8, 666, 9.2; 215/11.3; 222/95, 386
See application file for complete search history.

(56) References Cited

U.S. PATENT DOCUMENTS 1,235,550 A * 8/1917 Carmody ..... B65D 83/62 239/323
2,266,001 A * 12/1941 Christianson ..... B65D 21/086 220/666
3,107,712 A * 10/1963 Bergeretto ..... B65D 21/086 220/666
3,847,304 A * 11/1974 Cohen ..... B67D 7/0216 222/326
3,951,310 A * 4/1976 Steiman ..... B65D 83/75 222/340
6,745,918 B2 6/2004 Greene
7,487,878 B2 2/2009 Giwargis et al.
(Continued)

FOREIGN PATENT DOCUMENTS

RU 2183099 C2 6/2002
WO 1993005678 A1 4/1993

OTHER PUBLICATIONS

Daily Mail Reporter, The push-pop peanut butter jar that twists up to feed you more and revolutionizes a $2billion market, retrieved from internet, published on Jul. 29, 2013, retrieved on Jul. 10, 2024, <URL: https://www.dailymail.co.uk/news/article-2381062/Jar-With-Twist-The-push-pop-peanut-butter-jar-twists-feed-you.html>.

*Primary Examiner* — Don M Anderson
*Assistant Examiner* — Elizabeth J Volz

(57) ABSTRACT

A container with adjustable storage space is an apparatus that enables the user to easily retrieve all the product stored within the container. The apparatus includes a lid assembly, a tubular shell, an end cap, a raisable platform, and a gearing system. The lid assembly helps seal the tubular shell to protect the stored product within the apparatus to prolong the product life cycle. The tubular shell retains the raisable platform in such a manner that the raisable platform can be moved within the tubular shell. The raisable platform is used to adjust the storage space within the tubular shell to retain different amounts of product. The gearing system facilitates the controlled movement of the raisable platform within the tubular shell to adjust the storage space of the tubular shell. The end cap enables the user to manually engage the gearing system from outside the tubular shell.

13 Claims, 16 Drawing Sheets

(56) References Cited

U.S. PATENT DOCUMENTS

| | | | |
|---|---|---|---|
| 10,167,132 | B2 | 1/2019 | Sines |
| 2006/0201963 | A1 | 9/2006 | Sines et al. |

* cited by examiner

CONTAINER WITH ADJUSTABLE STORAGE SPACE

The current application claims a priority to the U.S. provisional patent application Ser. No. 63/596,512 filed on Nov. 6, 2023.

FIELD OF THE INVENTION

The present invention relates generally to storage containers and adjustable storage structures. More specifically, the present invention discloses a storage container with adjustable storage space.

BACKGROUND OF THE INVENTION

Nowadays, various storage containers are available to help people store different items for safekeeping and to prolong the product life cycles. Reusable storage containers are specially popular to help store food products including, but not limited to, condiments, sauces, and seasonings. In general, most reusable storage containers have a solid base with a shape and size large enough to store a predetermined amount of product. The solid base can be made from different solid materials (e.g., glass or plastic) and include an opening that allows access into the solid base. In addition, the opening of the solid base can be provided with a lid that can be used to seal the opening to help protect the stored product. While practical, this traditional design has many disadvantages that make the available storage containers cumbersome to use. Most storage containers have an opening that is not large enough for the user to freely access the product stored within. For example, reaching the product in the bottom of large containers with small openings can be difficult, especially for people with large hands. Therefore, there is a need for a storage container that facilitates access to the stored product regardless of the design, shape, or size of the storage container.

An objective of the present invention is to provide a container with adjustable storage space that facilitates access to stored items without the use of external tools. The design of the present invention allows the user to adjust the storage space within the container to hold different amounts of product. The design of the present invention also allows the user to easily retrieve the stored product until all the product in the container is consumed. Another objective of the present invention is to provide a container with adjustable storage space that can be provided as a reusable container. The present invention can be designed as a single-use container or as a reusable container that can be cleaned to store products repeatedly. Additional features and benefits of the present invention are discussed in the sections below.

SUMMARY OF THE INVENTION

The present invention discloses a container with adjustable storage space that facilitates the retrieval of the product stored within the container. The container of the present invention is designed to hold different amounts of product without altering the overall outer structure of the container. To do so, the present invention includes an internal platform that can be moved within the container to adjust the storage space available within the container. The internal platform can be selectively moved using a mechanism integrated into the container that can be manually engaged by the user. The user can move the internal platform closer to the opening of the container to position the stored products closer to the opening. Alternatively, the user can move the internal platform away from the opening of the container to provide more space to store the desired products.

Further, the present invention can include an internal lateral wall that helps retain products in a more controlled manner within the container. The internal lateral wall of the present invention facilitates the reuse of the container without obstructing the movement of the internal platform. The internal lateral wall can be provided in different versions that allow for different products to be stored. In addition, the different versions of the internal lateral wall can enable the insertion of the desired product into the container in different ways. For example, in one version, the internal lateral wall can be designed to allow the direct refilling of the container without the user having to remove the internal lateral wall. In another version, the internal lateral wall can be provided as a removable structure that comes pre-filled with the product in the form of a replaceable cartridge that make refilling of the container easy. Additional features can be implemented to improve the functionality of the present invention.

DETAILED DESCRIPTIONS OF THE INVENTION

Figure 1:
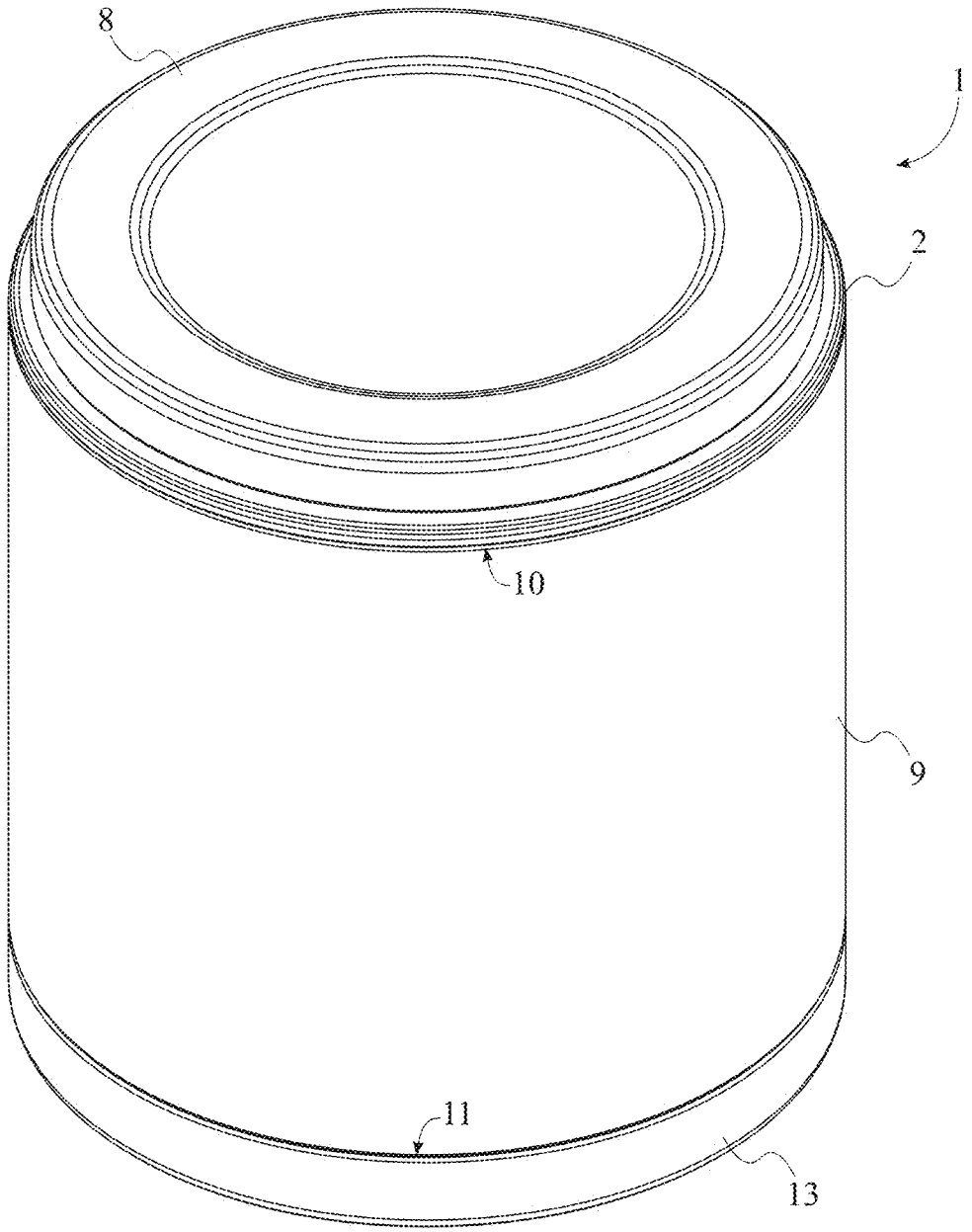
FIG. 1 is a top front perspective view of the present invention.
Figure 2:
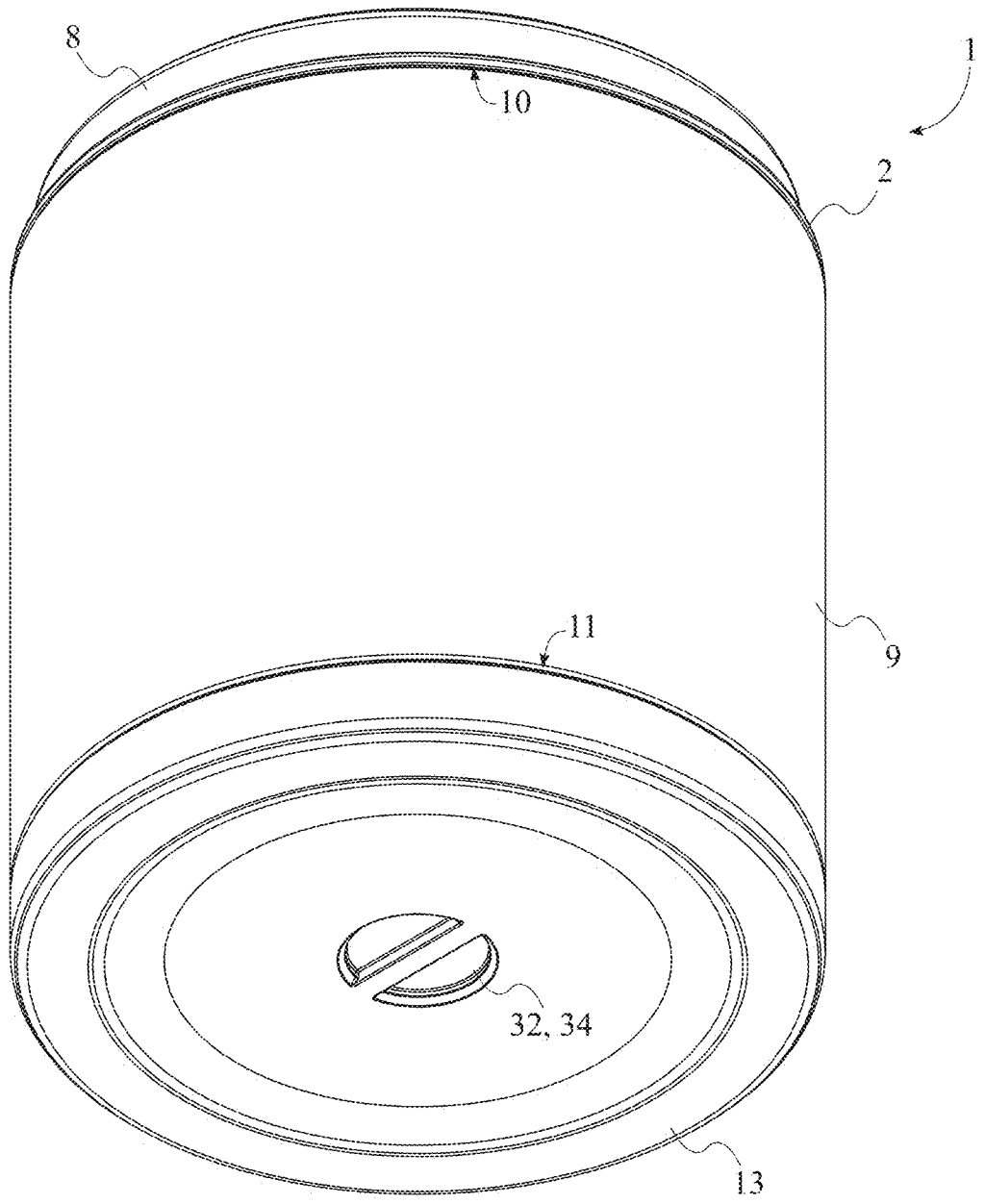
FIG. 2 is a bottom rear perspective view of the present invention.
Figure 3:
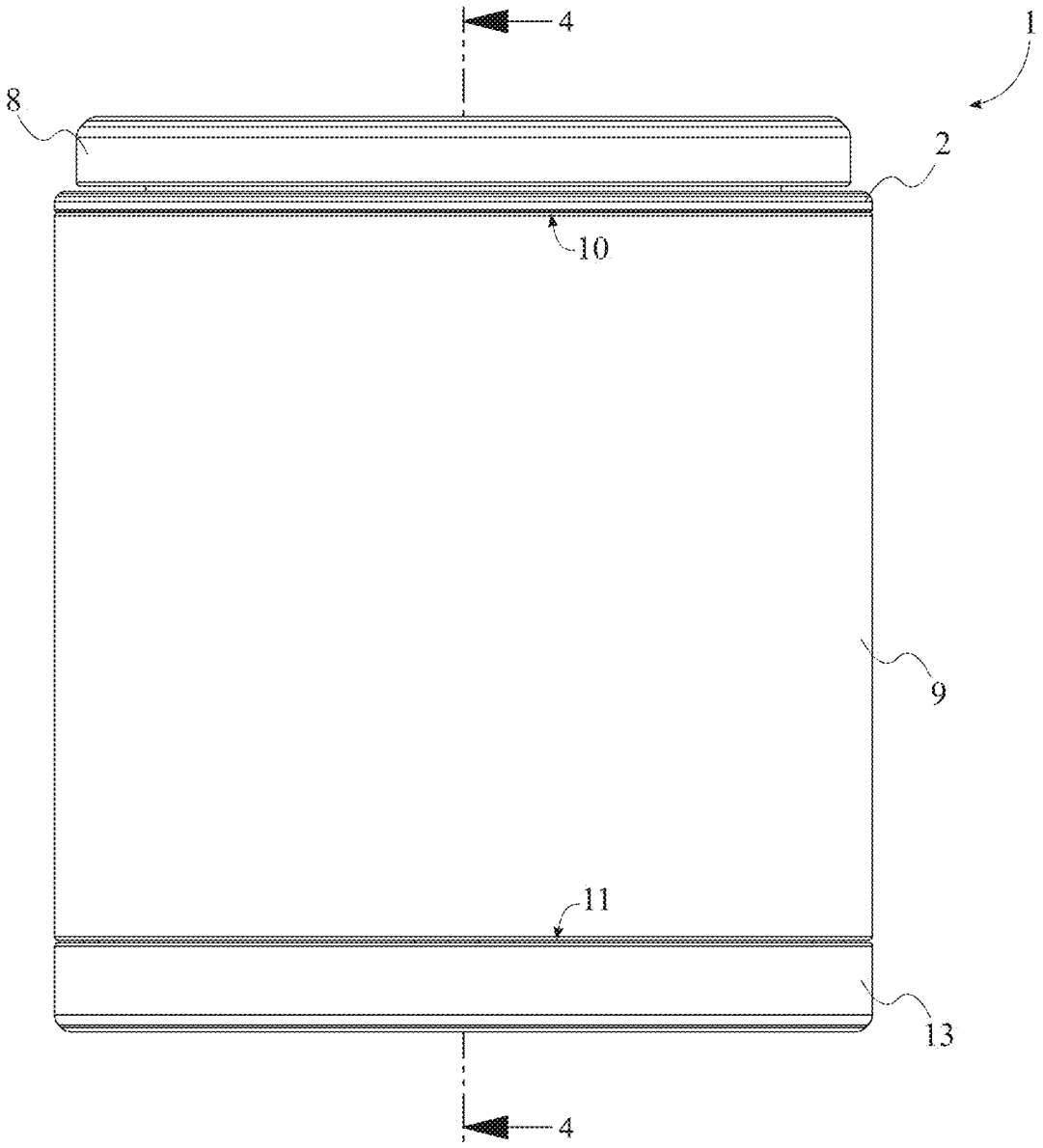
FIG. 3 is a front view of the present invention.
Figure 4:
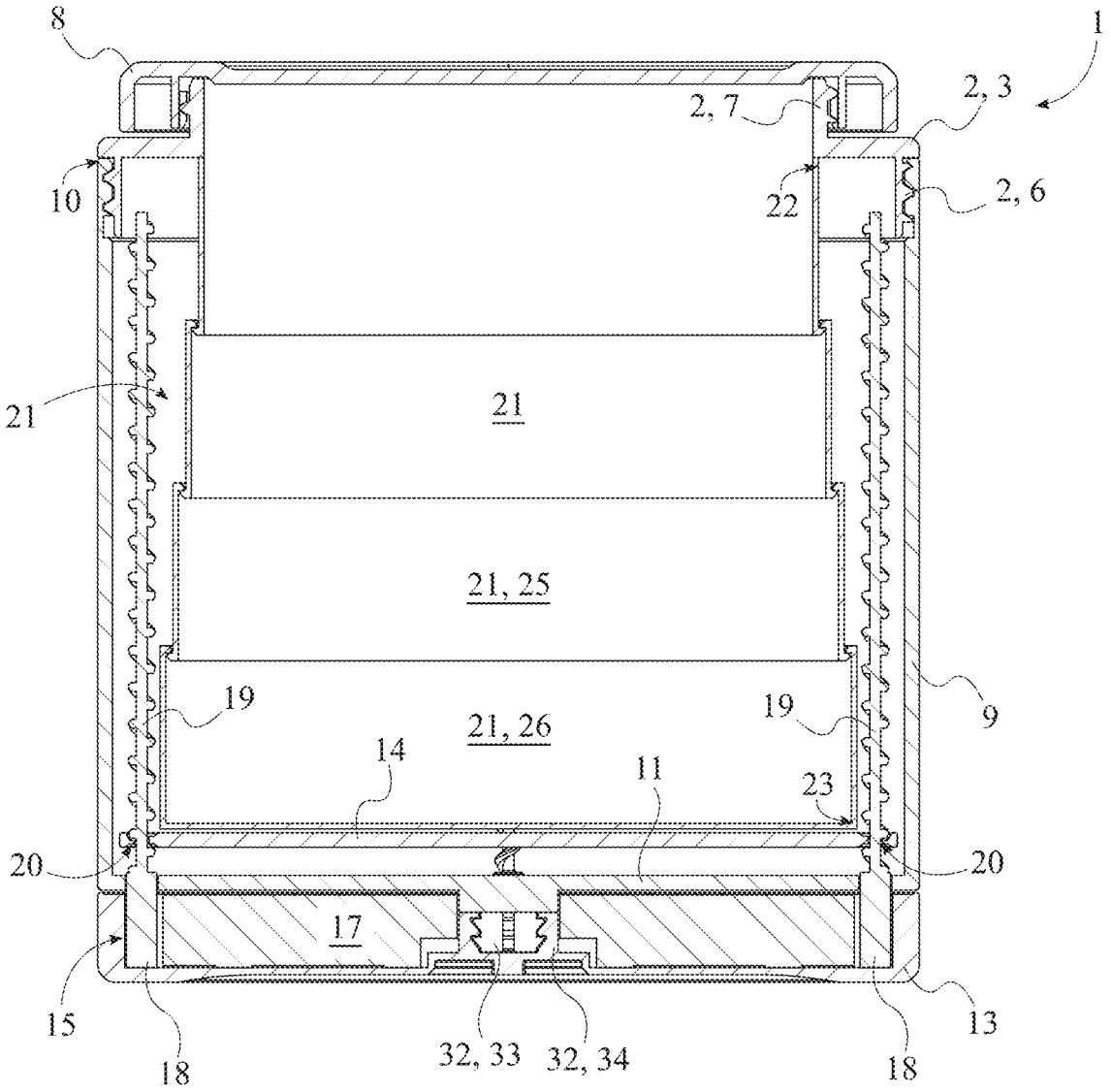
FIG. 4 is a vertical cross-sectional view of the present invention taken along line 4-4 shown in FIG. 3.
Figure 5:
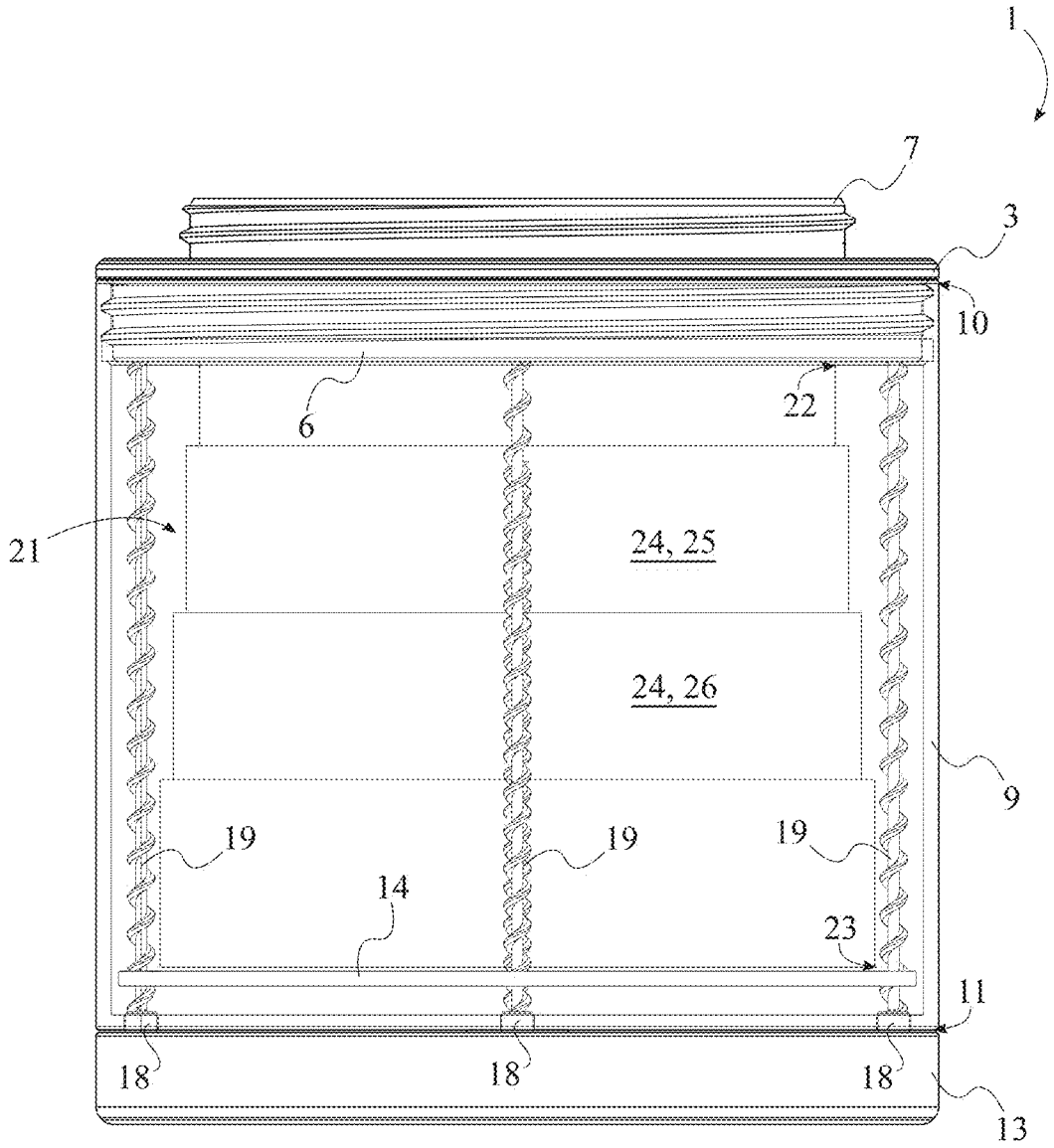
FIG. 5 is a front view of the present invention, wherein the tubular shell is shown as a transparent shell.
Figure 6:
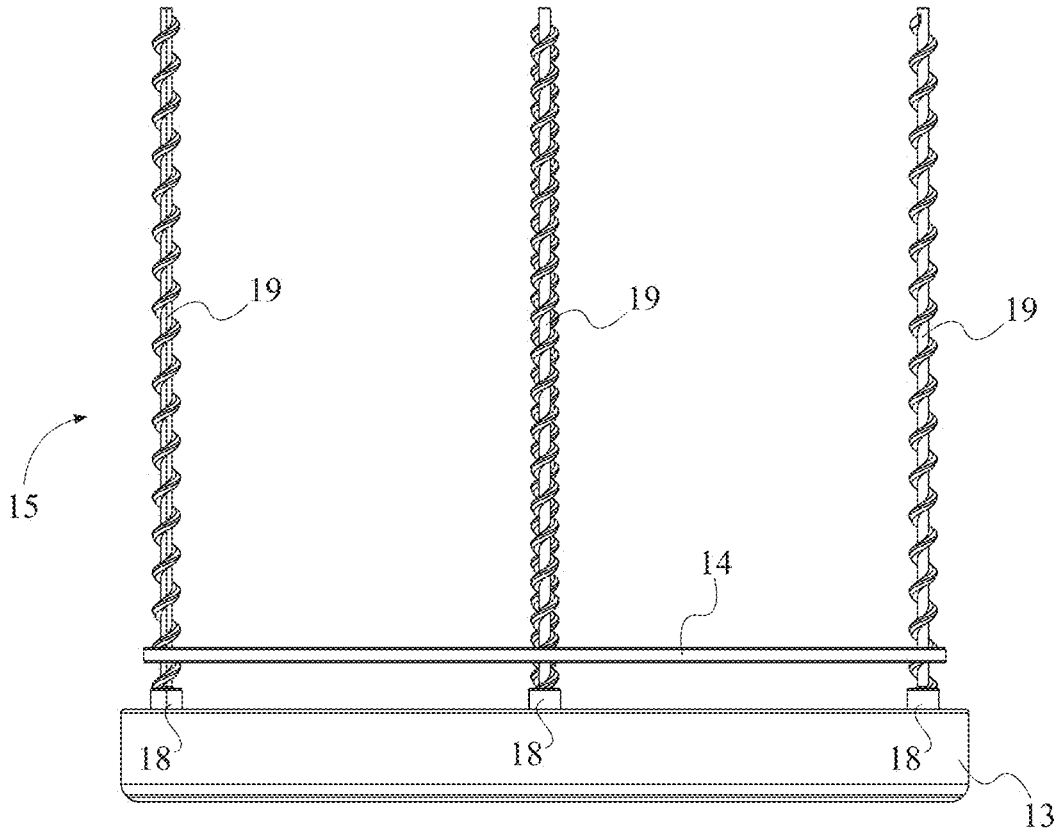
FIG. 6 is a front view of the present invention, wherein the present invention is shown without the lid assembly nor the tubular shell.
Figure 7:
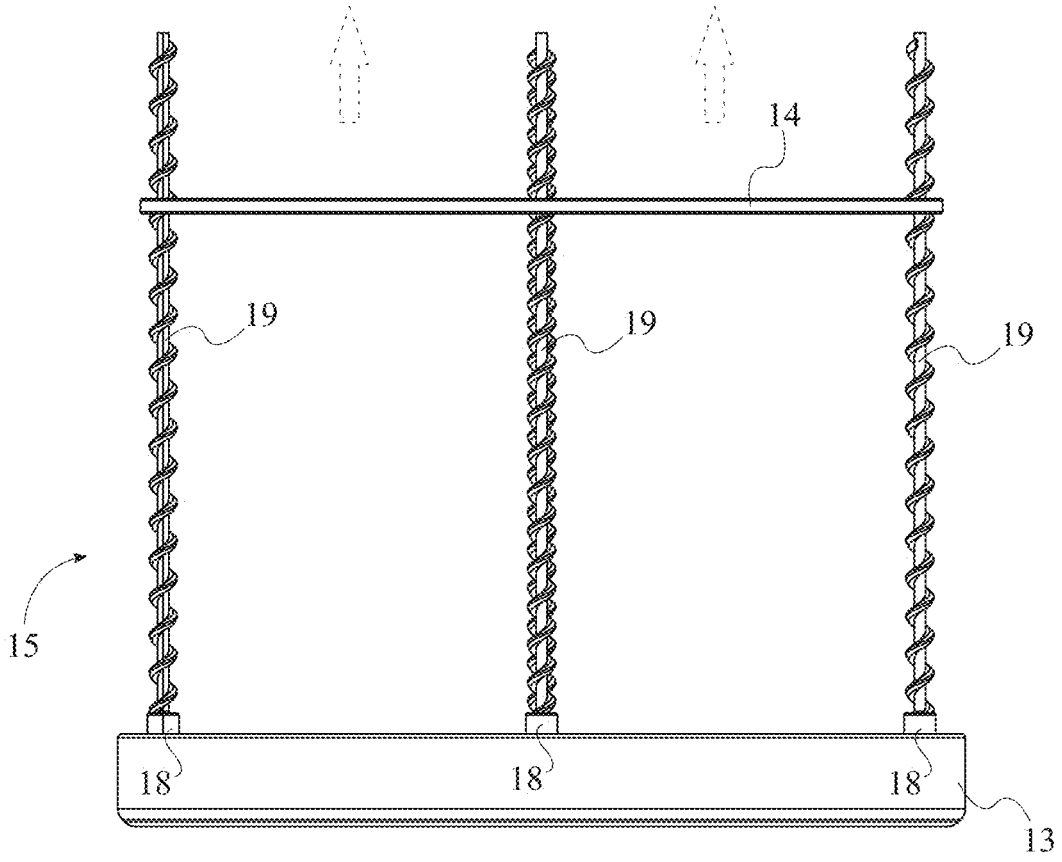
FIG. 7 is a front view of the present invention thereof, wherein the raisable platform is shown raised by the gearing system of the present invention.
Figure 8:
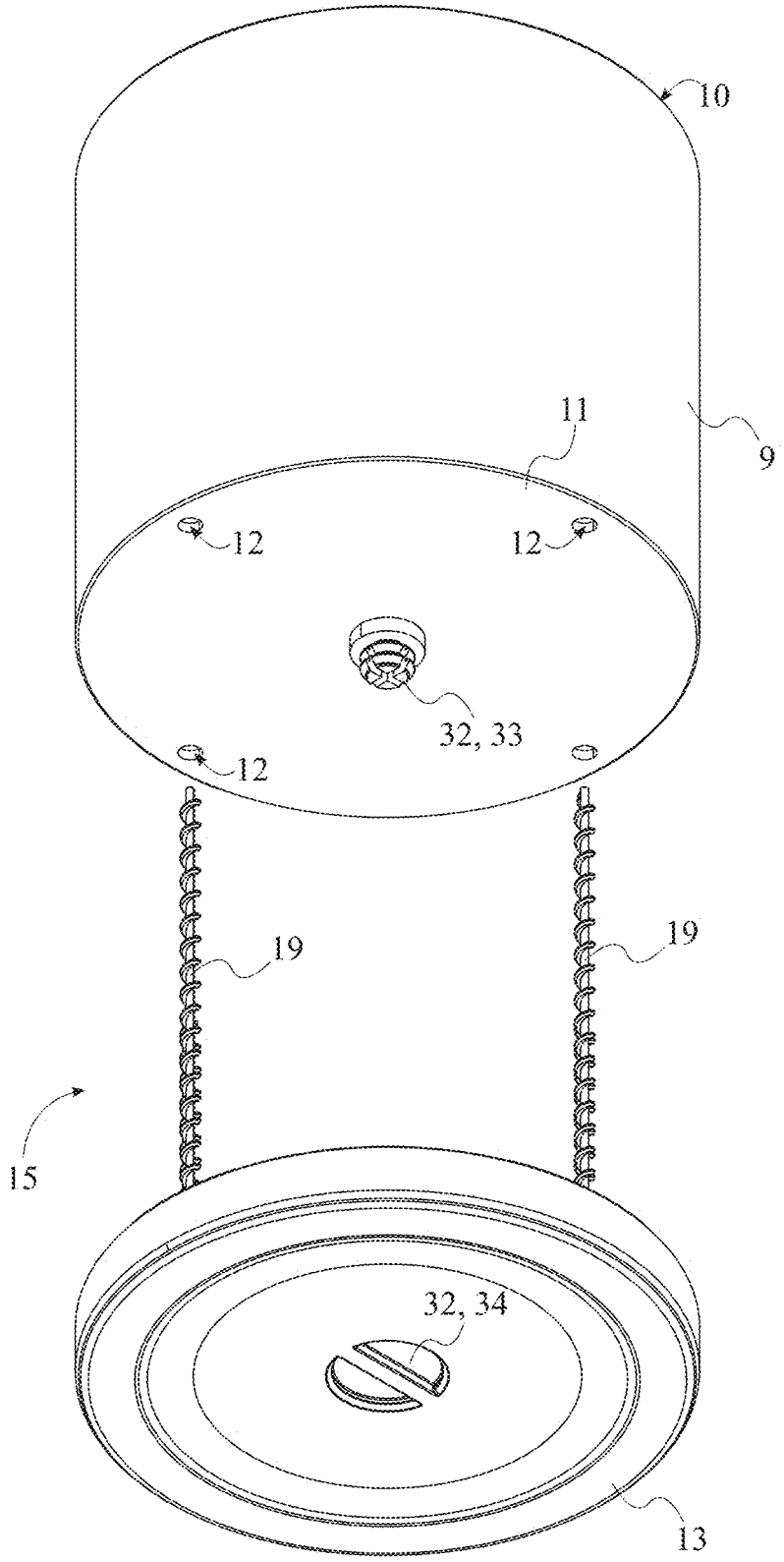
FIG. 8 is an exploded bottom rear perspective view of the present invention, wherein the present invention is shown without the lid assembly.
Figure 9:
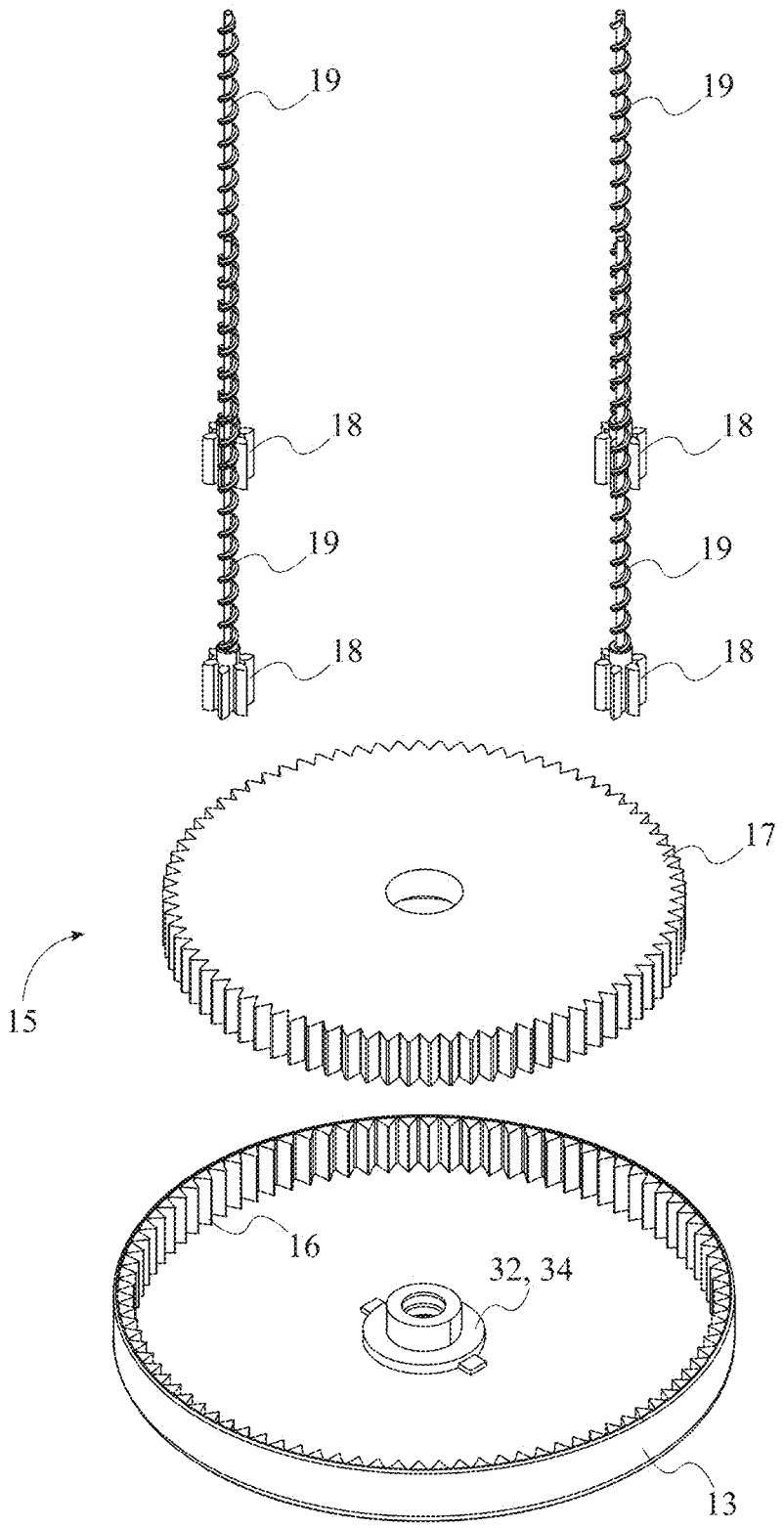
FIG. 9 is an exploded top front perspective view of the gearing system of the present invention.
Figure 10:
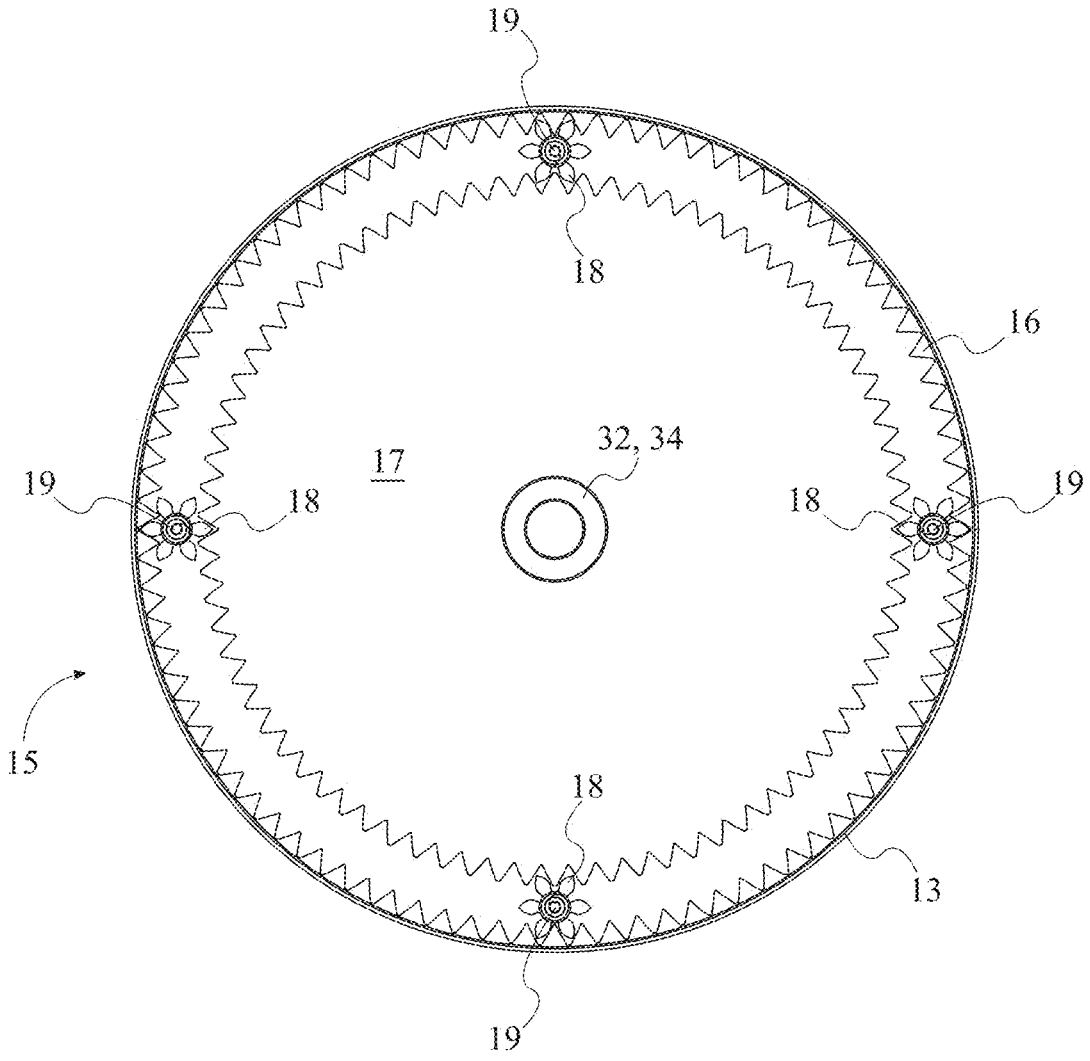
FIG. 10 is a top view of the gearing system of the present invention.
Figure 11:
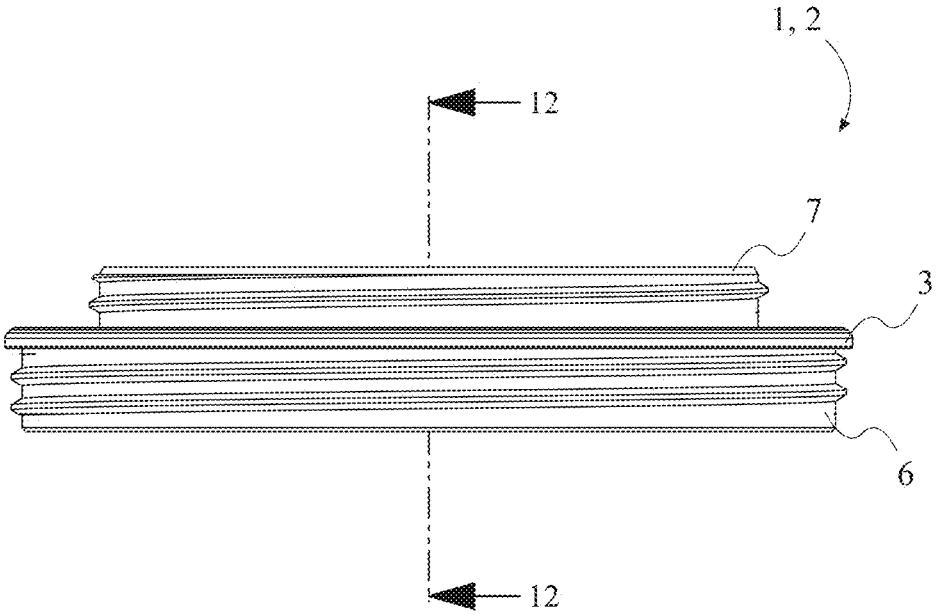
FIG. 11 is a front view of the lid collar of the lid assembly of the present invention.
Figure 12:
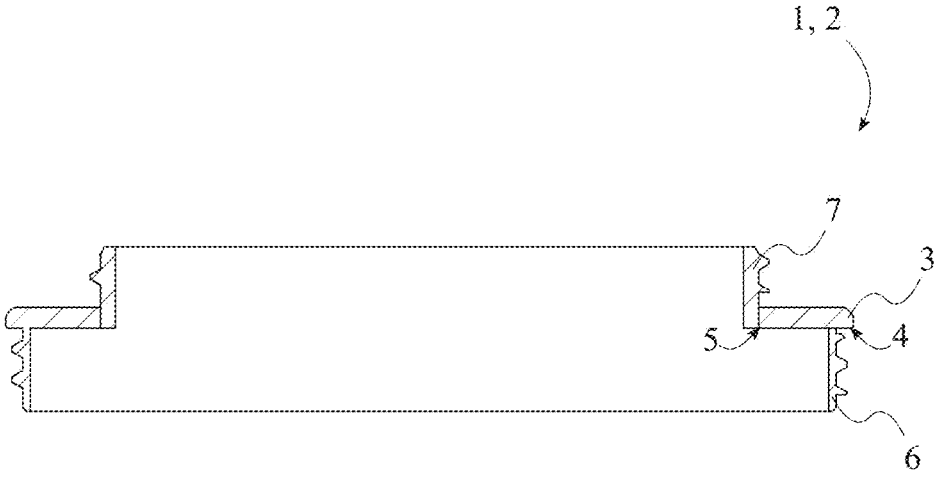
FIG. 12 is a vertical cross-sectional view of the present invention taken along line 12-12 shown in FIG. 11.

All illustrations of the drawings are for the purpose of describing selected versions of the present invention and are not intended to limit the scope of the present invention.

The present invention discloses a container with adjustable storage space. The present invention enables the user to easily retrieve all the product stored within the container. As can be seen in FIGS. 1 through 10, the present invention comprises a lid assembly 1, a tubular shell 9, an end cap 13, a raisable platform 14, and a gearing system 15. The lid assembly 1 helps seal the tubular shell 9 to protect the stored product within to prolong the product life cycle. The tubular shell 9 retains the raisable platform 14 in such a way that the raisable platform 14 can move inside the tubular shell 9. The raisable platform 14 is used to adjust the storage space within the tubular shell 9 to store different amounts of the desired product. The gearing system 15 facilitates the controlled movement of the raisable platform 14 within the tubular shell 9. The end cap 13 enables the user to manually engage the gearing system 15.

The general configuration of the aforementioned components enables the user to more easily store and retrieve products from a container, so no stored product is wasted. As can be seen in FIGS. 1 through 10, the tubular shell 9 is a hollow tubular structure with a shape and size large enough to accommodate the desired amount of product. For example, the tubular shell 9 can be a cylindrical structure made from a rigid material including, but not limited to, plastic, metal, etc. Further, the tubular shell 9 can be made from materials with different transparencies that can allow the user to monitor the products stored within. For example, the tubular shell 9 can be made from a transparent material, a translucent material, or an opaque material. However, other materials and designs can be implemented to help store the desired products within the tubular shell 9. Further, the tubular shell 9 comprises an open shell end 10 and a closed shell end 11 corresponding to the terminal ends of the tubular shell 9. The open shell end 10 preferably corresponds to the opening of the tubular shell 9, while the closed shell end 11 corresponds to the base of the tubular shell 9. Furthermore, the gearing system 15 comprises an internal spline 16, a sun gear 17, a plurality of planetary gears 18, and a plurality of lifting screws 19. The internal spline 16 and the sun gear 17 are designed to engage the plurality of planetary gears 18 to drive the rotation of the plurality of lifting screws 19 in a controlled manner. The plurality of planetary gears 18 and the plurality of lifting screws 19 enable the conversion of rotational motion to linear motion to move the raisable platform 14 within the tubular shell 9.

In the preferred embodiment, the present invention can be arranged as follows: the lid assembly 1, the tubular shell 9, the raisable platform 14, the end cap 13, and the sun gear 17 are axially positioned with each other due to the tubular design of the present invention, as can be seen in FIGS. 1 through 10. The raisable platform 14 is slidably positioned within the tubular shell 9 so that the raisable platform 14 can be moved via the gearing system 15. Further, the end cap 13 is positioned external to the tubular shell 9 so that the end cap 13 is accessible to the user to engage the gearing system 15. In addition, the end cap 13 is rotatably mounted onto the closed shell end 11 to secure the end cap 13 to the tubular shell 9 while enabling the rotation of the end cap 13 on the closed shell end 11. Further, the sun gear 17 is rotatably mounted onto the end cap 13 so that the sun gear 17 is retained within the end cap 13. Likewise, the internal spline 16 is also provided within the end cap 13 to make the internal spline 16 part of the end cap 13. The internal spline 16 is peripherally distributed around the end cap 13 so that several gear teeth are provided around the end cap 13. The internal spline 16 is also connected onto the end cap 13 to secure the internal spline 16 to the end cap 13.

As can be seen in FIGS. 1 through 10, the plurality of planetary gears 18 is further radially distributed around the sun gear 17 to provide balanced engagement to the raisable platform 14 within the tubular shell 9. Each of the plurality of planetary gears 18 is engaged in between the sun gear 17 and the internal spline 16 so that the rotation of each planetary gear is driven by the end cap 13. In other words, as the user rotates the end cap 13, the internal spline 16 causes the plurality of planetary gears 18 to rotate against the sun gear 17. The plurality of planetary gears 18 can be arranged so that clockwise rotation of the end cap 13 also rotate each planetary gear to rotate in a clockwise direction. Alternatively, the counterclockwise rotation of the end cap 13 rotates each planetary gear in a counterclockwise direction. Further, each of the plurality of planetary gears 18 is terminally connected to a corresponding lifting screw from the plurality of lifting screws 19. This way, the rotation of each planetary gear causes the connected lifting screw to rotate in the same direction. Each of the plurality of lifting screws 19 is positioned axially with a corresponding planetary gear from the plurality of planetary gears 18 to ensure that the plurality of lifting screws 19 is oriented perpendicular to the end cap 13. This prevents the potential malfunction of the gearing system 15. Further, each of the plurality of lifting screws 19 is rotatably positioned through the closed shell end 11 to allow the plurality of lifting screws 19 to engage with the raisable platform 14. Each of the plurality of lifting screws 19 is threadably engaged to the raisable platform 14 to connect the raisable platform 14 to the plurality of lifting screws 19. This way, the rotation of the plurality of planetary gears 18 is converted into linear motion of the raisable platform 14 inside the tubular shell 9. Finally, the lid assembly 1 is mounted onto the open shell end 10 to seal the storage space within the tubular shell 9.

As previously discussed, the plurality of lifting screws 19 traverses through closed shell end 11 so that the raisable platform 14 can be moved by the plurality of lifting screws 19. As can be seen in FIGS. 1 through 10, the tubular shell 9 may further comprise a plurality of shell holes 12 that allow the plurality of lifting screws 19 to pass through the closed shell end 11 without obstructing the rotation of each of the plurality of lifting screws 19. So, each of the plurality of shell holes 12 traverses normal through the closed shell end 11 to form openings large enough that accommodate the plurality of shell holes 12. In addition, the plurality of shell holes 12 is peripherally distributed around the closed shell end 11 to match the distribution of the plurality of lifting screws 19. Furthermore, each of the plurality of lifting screws 19 is rotatably positioned through a corresponding shell hole from the plurality of shell holes 12. In other embodiments, different mechanisms can be implemented to allow the plurality of lifting screws 19 to traverse into the tubular shell 9 through the closed shell end 11.

As can be seen in FIGS. 1 through 10, the linear movement of the raisable platform 14 is facilitated due to the engagement of the plurality of lifting screws 19 with the raisable platform 14. Each of the plurality of lifting screws 19 is preferably a threaded rod with a length that fits inside the tubular shell 9 and an overall diameter that fits within the corresponding shell hole. To facilitate the engagement of the raisable platform 14 with the plurality of lifting screws 19, the gearing system 15 may further comprise a plurality of threaded holes 20. The plurality of threaded holes 20 enables the engagement of the plurality of lifting screws 19 with the raisable platform 14. To do so, each of the plurality of threaded holes 20 is integrated normal through the raisable platform 14 to form openings with dimensions matching the dimensions of the plurality of lifting screws 19. The plurality of threaded holes 20 is also peripherally distributed around the closed shell end 11 to match the distribution of the plurality of lifting screws 19. Further, each of the plurality of lifting screws 19 is threadably engaged through a corresponding threaded hole from the plurality of threaded holes 20. The threading of the plurality of threaded holes 20 preferably matches the threading on each of the plurality of lifting screws 19 so that the engagement of each lifting screw with the corresponding threaded hole causes the raisable to move within the tubular shell 9. In alternate embodiments, different means can be implemented to enable the engagement of the plurality of lifting screws 19 with the raisable platform 14.

In general, the tubular shell 9 and the raisable platform 14 can retain solid products without risking malfunction of the gearing system 15 by the stored products. However, smaller products or liquid products may require additional support to separate the stored products from the gearing system 15. As can be seen in FIGS. 1 through 10, 13, and 14, the present invention may further comprise a telescopic lateral wall 21. The telescopic lateral wall 21 is designed to be provided within the tubular shell 9 to separate the stored products from the gearing system 15. The telescopic lateral wall 21 is preferably a tubular telescopic structure with an overall diameter smaller than the diameter of the tubular shell 9. The telescopic lateral wall 21 comprises a first telescoping end 22 and a second telescoping end 23 corresponding to the terminal ends of the telescopic lateral wall 21.

In the preferred embodiment, the telescopic lateral wall 21 can be implemented as follows: the telescopic lateral wall 21 is axially positioned with the tubular shell 9 to align the telescopic lateral wall 21 with the tubular shell 9, as can be seen in FIGS. 1 through 10, 13, and 14. The telescopic lateral wall 21 is also positioned within the tubular shell 9 to retain the stored product separate from the gearing system 15. In addition, the telescopic lateral wall 21 is positioned in between the open shell end 10 and the raisable platform 14 so that the telescopic rests on the raisable platform 14. Further, the first telescoping end 22 is hermetically connected to the lid assembly 1 so that the telescopic lateral wall 21 is secured to the lid assembly 1 without allowing the stored food products to escape the telescopic lateral wall 21. Furthermore, the second telescoping end 23 is hermetically connected to the raisable platform 14 to secure the telescopic lateral wall 21 to the raisable platform 14. In other embodiments, the telescopic lateral wall 21 can be implemented in different ways due to alternate configurations of the tubular shell 9 of the present invention.

Figure 13:
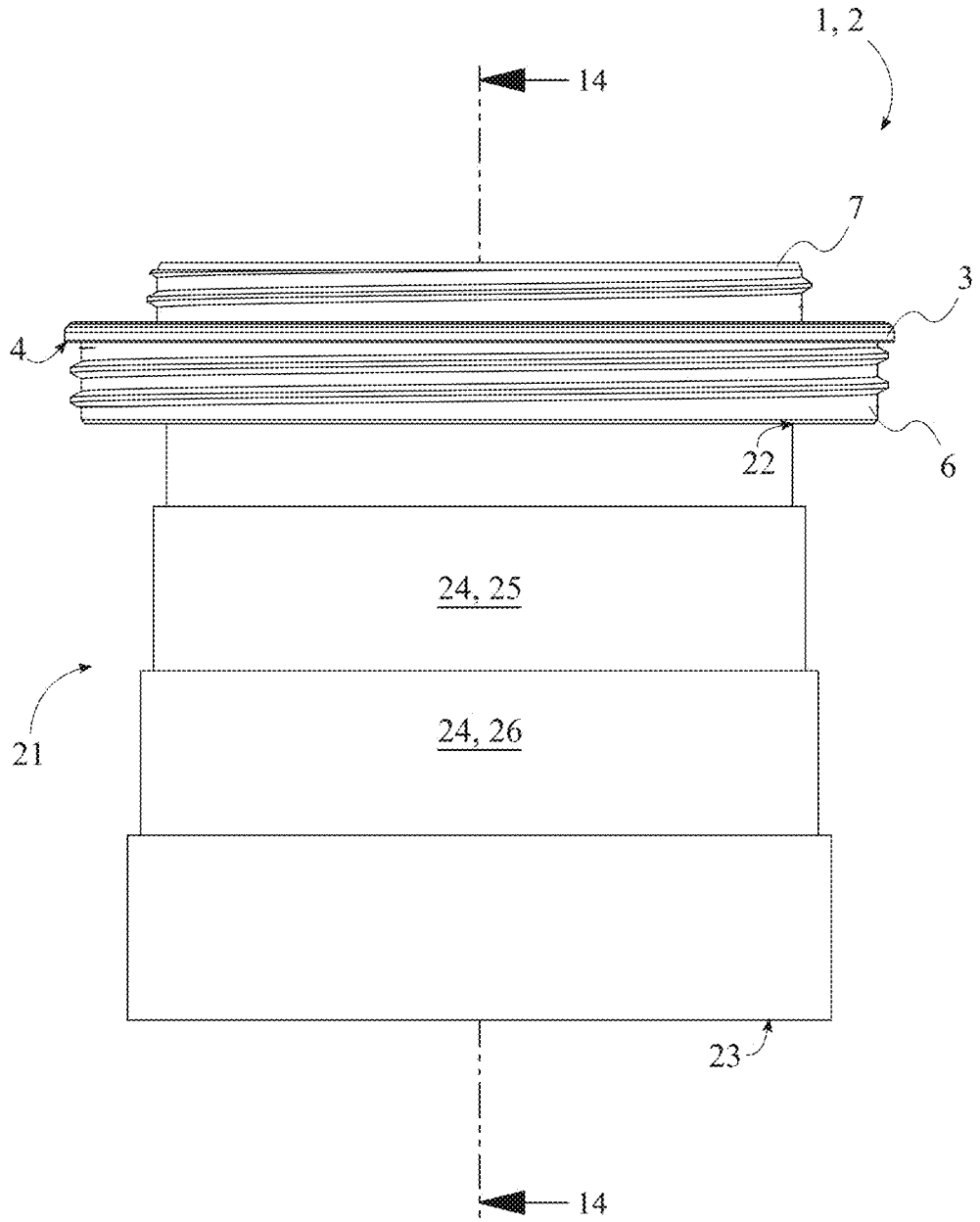
FIG. 13 is a front view of the lid collar of the lid assembly and the telescopic lateral wall of the present invention.
Figure 14:
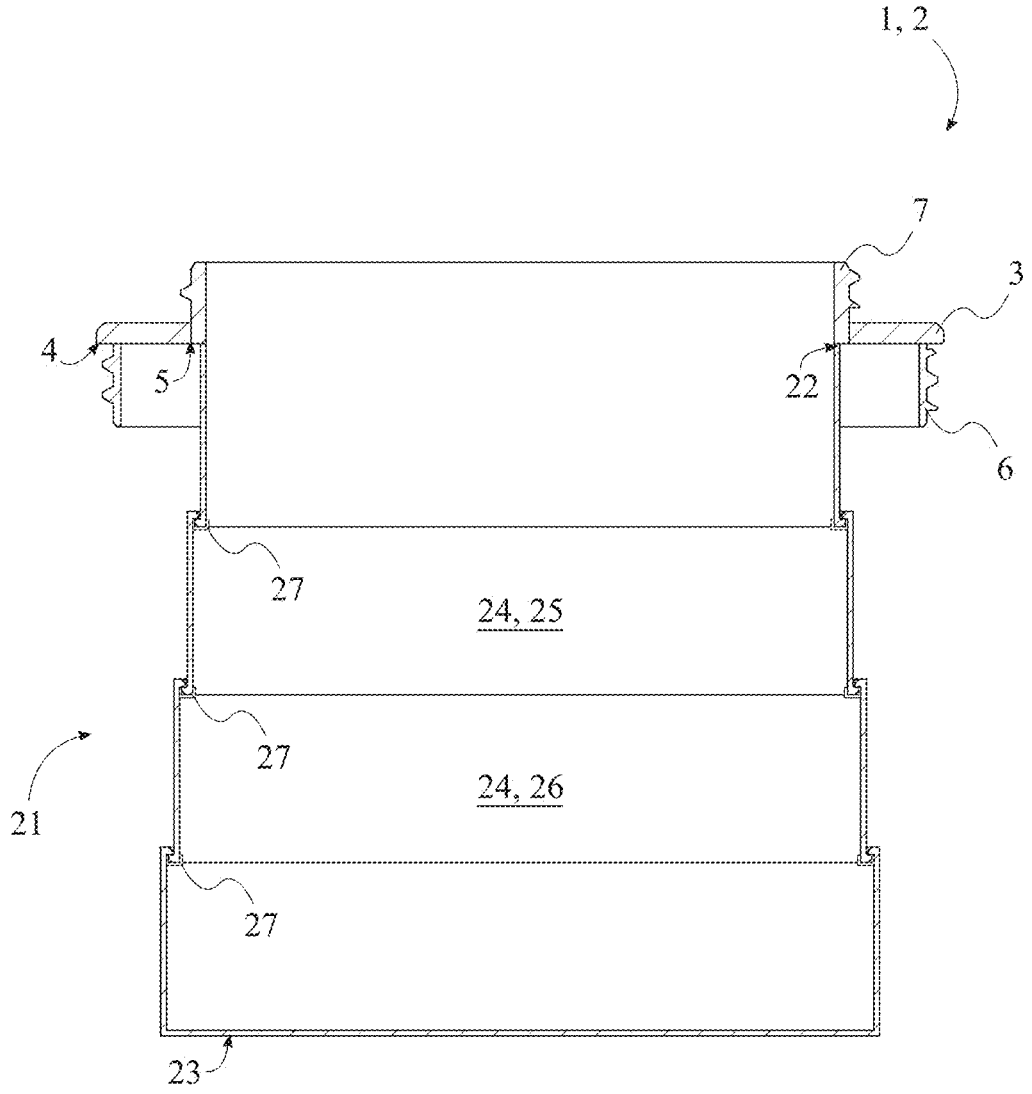
FIG. 14 is a vertical cross-sectional view of the present invention taken along line 14-14 shown in FIG. 13.

The telescopic lateral wall 21 can be provided in different versions to accommodate different products within the tubular shell 9. As can be seen in FIGS. 13 and 14, in one embodiment, the telescopic lateral wall 21 can be provided as a structure that includes several nested annular rings. So, the telescopic lateral wall 21 may comprise a plurality of nested annular portions 24 and a plurality of seal rings 27. The plurality of nested annular portions 24 corresponds to the several nested annular rings that are interconnected to form a single telescopic structure. The plurality of seal rings 27 prevent the retained products from leaking through gaps in between the plurality of nested annular portions 24. To form the telescopic lateral wall 21, an arbitrary annular portion is hermetically and telescopically engaged to an adjacent annular portion 26 by a corresponding seal ring from the plurality of seal rings 27. The arbitrary annular portion and the adjacent annular portion 26 are any adjacent pair of nested annular portions from the plurality of nested annular portions 24. This way, the telescopic lateral wall 21 can expand or contract as the raisable platform 14 is moved within the tubular shell 9 using the gearing system 15.

Figure 15:
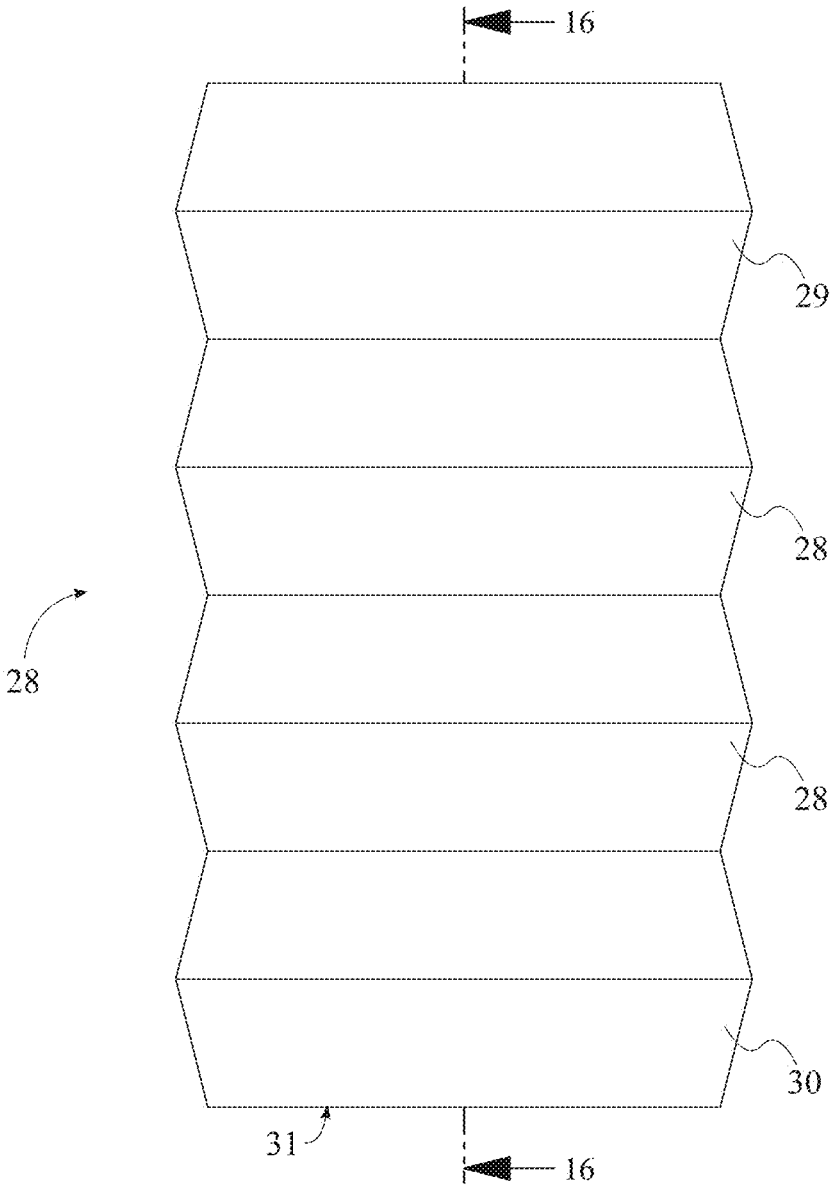
FIG. 15 is a front view of the pleated lateral wall of the present invention.
Figure 16:
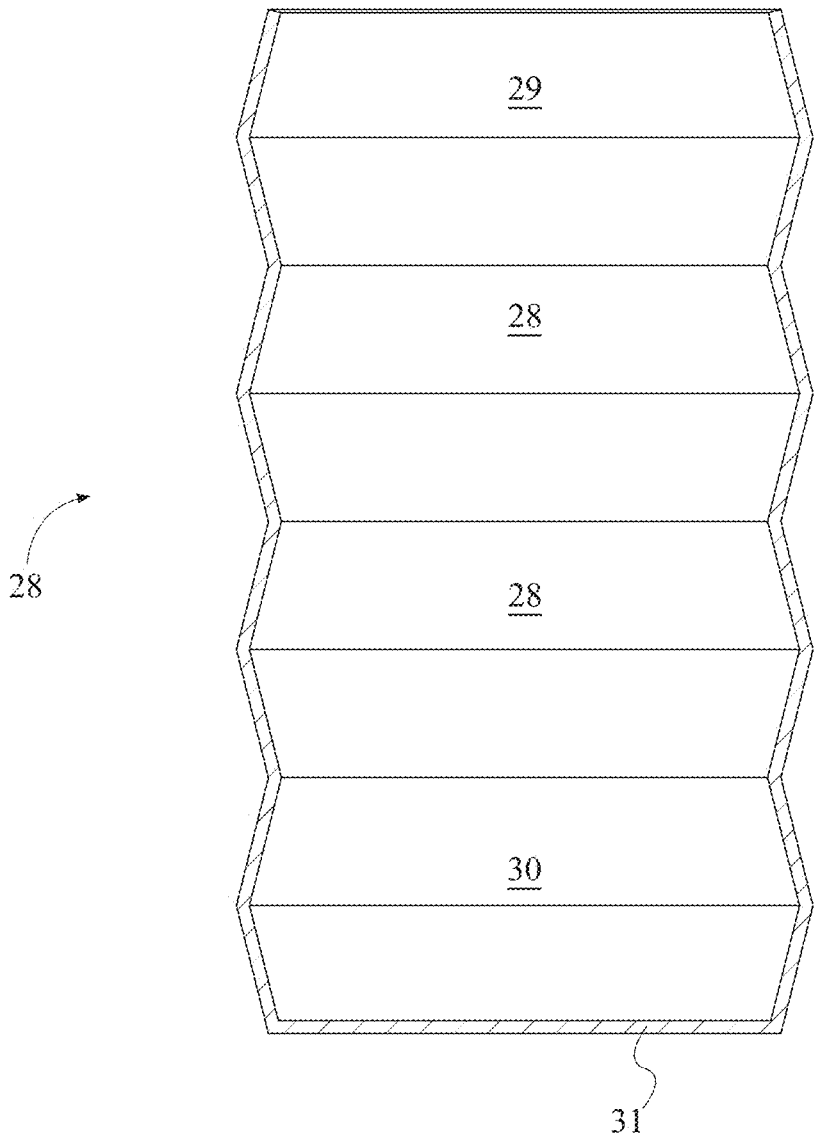
FIG. 16 is a vertical cross-sectional view of the present invention taken along line 16-16 shown in FIG. 15.

In an alternate embodiment, the telescopic lateral wall 21 can be provided as single structure that can expand or contract within the tubular shell 9 to adjust the internal storage space. As can be seen in FIGS. 15 and 16, the present invention may further comprise a pleated lateral wall 28 and a flexible base 31. The pleated lateral wall 28 is a closed structure that can be expanded or contracted in the same manner as the telescopic lateral wall 21. In addition, the pleated lateral wall 28 comprises a first pleat end 29 and a second pleat end 30 corresponding to the terminal ends of the pleated lateral wall 28. Further, the flexible base 31 enables the closure of one end of the pleated lateral wall 28 so that the desired food product is retained within the pleated lateral wall 28. In this embodiment, the pleated lateral wall 28 can be implemented as follows: the pleated lateral wall 28 is axially positioned with the tubular shell 9 to align the pleated lateral wall 28 with the tubular shell 9. The pleated lateral wall 28 is also positioned within the tubular shell 9 to keep the stored product separate from the gearing system 15. Like the telescopic lateral wall 21, the pleated lateral wall 28 is positioned in between the open shell end 10 and the raisable platform 14. Further, the first pleat end 29 is hermetically attached to the lid assembly 1 to secure the pleated lateral wall 28 to the lid assembly 1. On the other hand, the second pleat end 30 is hermetically and perimetrically connected around the flexible base 31 to secure the flexible base 31 to the pleated lateral wall 28. Furthermore, the flexible base 31 is situated upon the raisable platform 14 so that the flexible base 31 rests on the raisable platform 14.

The present invention can enable the user to refill the desired product directly into the tubular shell 9 in different ways. In one embodiment, the pleated lateral wall 28 and the flexible base 31 can be provided as a single-use receptacle that is only used once and discarded afterwards. The single-use receptacle can be pre-filled with a predetermined amount of product that the user can consume and then discard the container. In another embodiment, the pleated lateral wall 28 and the flexible base 31 can be provided as functional components of a single-use pod retaining a consumable product. In other words, the single-use pod serves as a replaceable cartridge that the user can replace whenever the user finishes consuming the product. The single-use pod is one pod from a plurality of single-use pods, and the plurality of single-use pods is a pod replacement system. The user can remove the empty single-use pod from the container and insert the new single-use pod into the container. In other embodiments, different mechanisms can be implemented to help the user refill the container of the present invention.

As previously discussed, the lid assembly 1 is designed to seal the tubular shell 9 to help protect the stored products and increase the product life cycle. The lid assembly 1 can be designed to accommodate the telescopic lateral wall 21 and the pleated lateral wall 28. As can be seen in FIGS. 1 through 10, the lid assembly 1 may comprise a lid collar 2 and a removable lid 8. The removable lid 8 enables the selective sealing of the tubular shell 9 whenever the user wants to access the stored products. The removable lid 8 may have a size large enough to cover the first telescoping end 22 or the first pleat end 29. In addition, the removable lid 8 may include a flexible seal that helps seal the connection between the removable lid 8 and the lid collar 2 to further protect the stored products. The lid collar 2 accommodates a removable lid 8 that may have an overall diameter that is smaller than the overall diameter of the tubular shell 9. So, the lid collar 2 comprises an annular collar base 3, a proximal lateral wall 6, and a distal lateral wall 7. The annular collar base 3 corresponds to the main structure of the lid collar 2. The proximal lateral wall 6 enables the attachment of the lid collar 2 to the tubular shell 9. The distal lateral wall 7 enables the attachment of the removable lid 8 to the lid collar 2. In addition, the annular collar base 3 comprises an outer base edge 4 and an inner base edge 5 corresponding to the annular edges of the annular collar base 3.

As can be seen in FIGS. 1 through 10, this embodiment of the lid assembly 1 can be arranged as follows: the proximal lateral wall 6 and the distal lateral wall 7 are positioned perpendicular to the annular collar base 3 to match the cylindrical design of the container. Further, the proximal lateral wall 6 is connected around the outer base edge 4 to secure the proximal lateral wall 6 to the annular collar base 3. In addition, the proximal lateral wall 6 is threadably engaged to the open shell end 10 to enable the attachment of the lid assembly 1 to the tubular shell 9. Similarly, the distal lateral wall 7 is connected around the inner base edge 5 to secure the distal lateral wall 7 to the annular collar base 3. Further, the removable lid 8 is threadably engaged to the distal lateral wall 7 to allow the user to removably attach the removable lid 8 to the lid collar 2. In other embodiments, the lid assembly 1 may be modified to accommodate a removable lid 8 with larger dimensions to accommodate a wider telescopic lateral wall 21 or a wider pleated lateral wall 28. Alternatively, the lid assembly 1 may be altered to allow the direct attachment of the removable lid 8 to the tubular shell 9.

As previously discussed, the end cap 13 is designed to be attached to the closed shell end 11 in such a way that the end cap 13 can be rotated about the tubular shell 9. As can be seen in FIGS. 1 through 10, in some embodiments, an attachment mechanism can be implemented to allow the end cap 13 to be removably attached so that the user can perform maintenance on the gearing system 15. The present invention may further comprise a push-click attachment mechanism 32 that allows the removable attachment of the end cap 13 to the closed shell end 11 without obstructing the rotation of the end cap 13. To do so, the push-click attachment mechanism 32 comprises a first interlocking piece 33 and a second interlocking piece 34 that facilitate the removable attachment of the end cap 13 to the closed shell end 11. The first interlocking piece 33 is axially connected onto the closed shell end 11 to secure the first interlocking piece 33 to the tubular shell 9. On the other hand, the second interlocking piece 34 is axially connected onto the end cap 13 to secure the second interlocking piece 34 to the end cap 13. Further, the first interlocking piece 33 and the second interlocking piece 34 are axially aligned with the tubular shell 9 and the end cap 13 to keep the end cap 13 also axially aligned with the tubular shell 9. Furthermore, the first interlocking piece 33 and the second interlocking piece 34 are rotatably attached to each other to enable the removable attachment of the end cap 13 to the tubular shell 9. In other embodiments, different mechanisms can be implemented to facilitate the removable attachment of the end cap 13 to the tubular shell 9.

Although the invention has been explained in relation to its preferred embodiment, it is to be understood that many other possible modifications and variations can be made without departing from the spirit and scope of the invention.

What is claimed is:

1. A container with adjustable storage space comprising:
- a lid assembly;
- a tubular shell;
- an end cap;
- a raisable platform;
- a gearing system;
- the tubular shell comprising an open shell end and a closed shell end;
- the gearing system comprising an internal spline, a sun gear, a plurality of planetary gears, and a plurality of lifting screws;
- the lid assembly, the tubular shell, the raisable platform, the end cap, and the sun gear being axially positioned with each other;
- the raisable platform being slidably positioned within the tubular shell;
- the end cap being positioned external to the tubular shell;
- the end cap being rotatably mounted onto the closed shell end;
- the sun gear being rotatably mounted onto the end cap;
- the internal spline being peripherally distributed around the end cap;
- the internal spline being connected onto the end cap;
- the plurality of planetary gears being radially distributed around the sun gear;
- each of the plurality of planetary gears being engaged in between the sun gear and the internal spline;
- each of the plurality of planetary gears being terminally connected to a corresponding lifting screw from the plurality of lifting screws;
- each of the plurality of lifting screws being positioned axially with a corresponding planetary gear from the plurality of planetary gears;
- each of the plurality of lifting screws being rotatably positioned through the closed shell end;
- each of the plurality of lifting screws being threadably engaged to the raisable platform; and
- the lid assembly being mounted onto the open shell end.

2. The container with adjustable storage space as claimed in claim 1 further comprising:
- the tubular shell further comprising a plurality of shell holes;
- each of the plurality of shell holes traversing normal through the closed shell end;
- the plurality of shell holes being peripherally distributed around the closed shell end; and
- each of the plurality of lifting screws being rotatably positioned through a corresponding shell hole from the plurality of shell holes.

3. The container with adjustable storage space as claimed in claim 1 further comprising:
- the gearing system further comprising a plurality of threaded holes;
- each of the plurality of threaded holes being integrated normal through the raisable platform;
- the plurality of threaded holes being peripherally distributed around the closed shell end; and
- each of the plurality of lifting screws being threadably engaged through a corresponding threaded hole from the plurality of threaded holes.

4. The container with adjustable storage space as claimed in claim 1 further comprising:
- a telescopic lateral wall;
- the telescopic lateral wall comprising a first telescoping end and a second telescoping end;
- the telescopic lateral wall being axially positioned with the tubular shell;
- the telescopic lateral wall being positioned within the tubular shell;

the telescopic lateral wall being positioned in between the open shell end and the raisable platform;

the first telescoping end being hermetically connected to the lid assembly; and the second telescopic end being hermetically connected to the raisable platform.

5. The container with adjustable storage space as claimed in claim 4 further comprising:

the telescopic lateral wall comprising a plurality of nested annular portions and a plurality of seal rings; and an arbitrary annular portion being hermetically and telescopically engaged to an adjacent annular portion by a corresponding seal ring from the plurality of seal rings, wherein the arbitrary annular portion and the adjacent annular portion are any adjacent pair of nested annular portions from the plurality of nested annular portions.

6. The container with adjustable storage space as claimed in claim 1 further comprising:

a pleated lateral wall;

a flexible base;

the pleated lateral wall comprising a first pleat end and a second pleat end;

the pleated lateral wall being axially positioned with the tubular shell;

the pleated lateral wall being positioned within the tubular shell;

the pleated lateral wall being positioned in between the open shell end and the raisable platform;

the first pleat end being hermetically attached to the lid assembly;

the second pleat end being hermetically and perimetrically connected around the flexible base; and the flexible base being situated upon the raisable platform.

7. The container with adjustable storage space as claimed in claim 6, wherein the pleated lateral wall and the flexible base are a single-use receptacle.

8. The container with adjustable storage space as claimed in claim 6, wherein the pleated lateral wall and the flexible base are functional components of a single-use pod retaining a consumable product, and wherein the single-use pod is one pod from a plurality of single-use pods, and wherein the plurality of single-use pods is a pod replacement system.

9. The container with adjustable storage space as claimed in claim 1 further comprising:

the lid assembly comprising a lid collar and a removable lid;

the lid collar comprising an annular collar base, a proximal lateral wall, and a distal lateral wall;

the annular collar base comprising an outer base edge and an inner base edge;

the proximal lateral wall and the distal lateral wall being positioned perpendicular to the annular collar base;

the proximal lateral wall being connected around the outer base edge;

the proximal lateral wall being threadably engaged to the open shell end;

the distal lateral wall being connected around the inner base edge; and the removable lid being threadably engaged to the distal lateral wall.

10. The container with adjustable storage space as claimed in claim 1 further comprising:

a push-click attachment mechanism;

the push-click attachment mechanism comprising a first interlocking piece and a second interlocking piece;

the first interlocking piece being axially connected onto the closed shell end;

the second interlocking piece being axially connected onto the end cap; and the first interlocking piece and the second interlocking piece being rotatably attached to each other.

11. The container with adjustable storage space as claimed in claim 1, wherein the tubular shell is made of a transparent material.

12. The container with adjustable storage space as claimed in claim 1, wherein the tubular shell is made of a translucent material.

13. The container with adjustable storage space as claimed in claim 1, wherein the tubular shell is made of an opaque material.

* * * * *